United States Patent [19]

Hirakawa et al.

[11] Patent Number: 4,501,641

[45] Date of Patent: Feb. 26, 1985

[54] PROCESS FOR PRODUCING PAPER OR NON-WOVEN FABRIC

[75] Inventors: Tadashi Hirakawa, Kusatsu; Makoto Yoshida, Ibaraki, both of Japan

[73] Assignee: Teijin Limited, Osaka, Japan

[21] Appl. No.: 403,544

[22] Filed: Jul. 30, 1982

[30] Foreign Application Priority Data

Feb. 18, 1981 [JP] Japan ..... 56-21378
Apr. 2, 1981 [JP] Japan ..... 56-48381

[51] Int. Cl.[3] ..... D21H 3/60

[52] U.S. Cl. ..... 162/164.3; 162/164.5; 162/168.1; 162/164.1

[58] Field of Search ..... 162/164.1, 164.3, 164.5, 162/168.1

[56] References Cited

U.S. PATENT DOCUMENTS

| | | | |
|---|---|---|---|
| 3,660,338 | 5/1972 | Economou | 162/164.3 |
| 3,766,002 | 10/1973 | Greif et al. | 162/164.1 |
| 4,002,588 | 1/1977 | Strazdins | 162/164.3 |
| 4,121,966 | 10/1978 | Amano et al. | 162/168.1 |

FOREIGN PATENT DOCUMENTS 1237671 6/1971 United Kingdom .

*Primary Examiner*—William Smith
*Attorney, Agent, or Firm*—Burgess, Ryan & Wayne

[57] ABSTRACT

A process for producing paper or wet non-woven fabric comprising mixing an aqueous anionic polymer solution with an aqueous cationic polymer solution, adding the mixture to a slurry of fiber or pulp, converting the slurry into paper or non-woven fabric by a wet paper-making technique, and drying the paper or non-woven fabric. The paper or non-woven fabric advantageously has an excellent strength, water resistance, and thermal resistance.

4 Claims, 1 Drawing Figure

PROCESS FOR PRODUCING PAPER OR NON-WOVEN FABRIC

Figure 1:
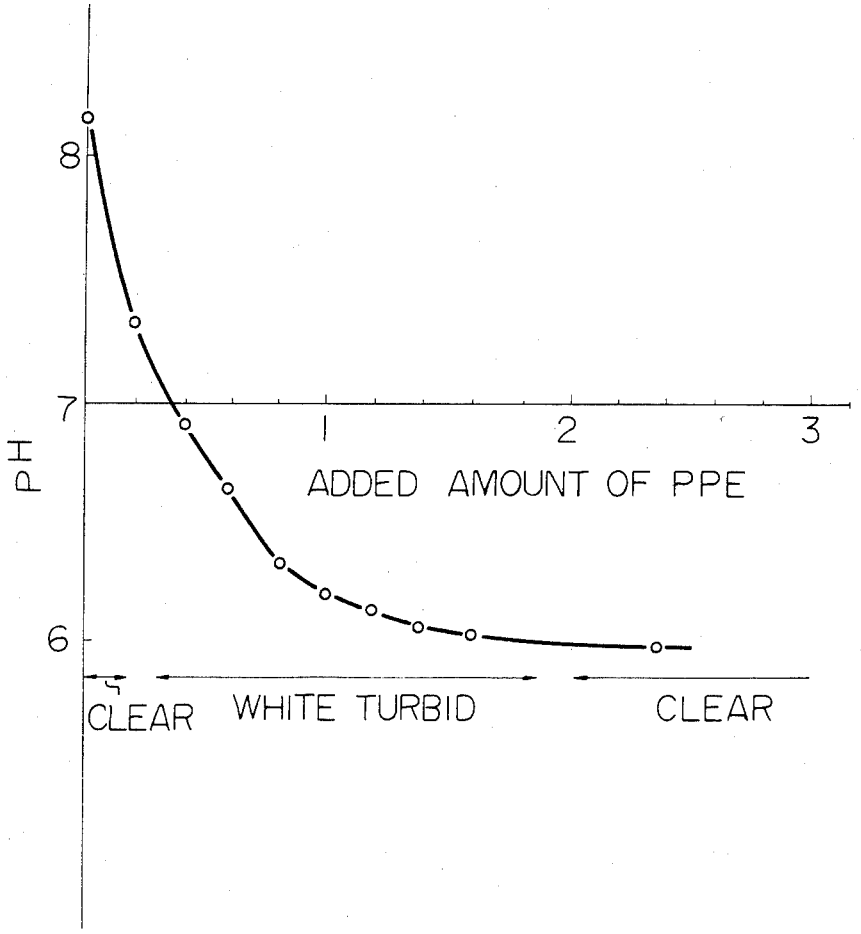

The invention relates to a process for producing paper or wet non-woven fabric. More particularly, the invention relates to a process for producing, by a wet papermaking technique, paper or wet non-woven fabric having an excellent strength, water resistance, and bulkiness.

Fibrous binders and synthetic resin emulsions have generally been employed as an internal binder in the production of paper or non-woven fabric by a wet papermaking process of fiber or pulp. As the fibrous binders, there have broadly been employed hot water-soluble or low melting point resins such as polyvinyl alcohol, polyethylene, ethylene-vinyl acetate copolymer and copolyesters in the form of fiber. However, paper or non-woven fabric obtained by using polyvinyl alcohol fiber as the fibrous binder has a poor water resistance, thermal resistance, softness, and strength. In the case where polyethylene, ethylene-vinyl acetate copolymer and copolyesters are used as fibrous binders, it is difficult to separate the paper sheet from the drying cylinder or dryer canvas in the papermaking process, and the resultant paper or non-woven fabric has a low strength.

When synthetic resin emulsions are used, the emulsions are demulsified with a salt of a polyvalent metal to form the aggregate of the synthetic resin, which is then deposited on the fibers in a fiber slurry. In this case, there may be disadvantages in that the fibers themselves aggregate due to the aggregating action of the polyvalent metal salt, the aggregate of the resin has a poor durability, the stoppage of a forming wire occurs, foaming occurs due to the emulsifier, and the resultant paper or non-woven fabric has a poor surface texture.

Thus, it is the primary object of the present invention to provide a process for the production of paper or non-woven fabric having an excellent strength, water resistance, thermal resistance, and softness by means of a conventional wet papermaking technique.

The present invention therefore provides a process for producing paper or wet non-woven fabric, which process comprises mixing an aqueous anionic polymer solution with an aqueous cationic polymer solution, adding the mixture to a slurry of fiber or pulp, converting the slurry into paper or non-woven fabric by a wet papermaking technique, and drying the paper or non-woven fabric.

In the present invention, it is presumed that the anionic polymer generally acts as a binder, and the cationic polymer generally acts to aggregate the anionic polymer, to fix the thus formed aggregate to the fiber or pulp, and optionally to cross-link the anionic polymer. The "aqueous anionic polymer solution" or "aqueous cationic polymer solution" as used herein refers to an aqueous liquid in which the anionic polymer or cationic polymer is dissolved in water or dispersed in water without the assistance of any emulsifying or dispersing agents.

The anionic polymer usable for the present invention may include water-soluble polymers having on the backbone, ends, or side chains thereof one or more acid groups, such as carboxyl (—COOH), sulfino (—SOOH), sulfo (—$SO_2OH$), sulfoamino (—NH-$SO_2OH$), aci-nitro (—NOOH), hydroxyamino (—N-HOH), hydroxyimino (—NOH), or sodiosulfo (—$SO_2ONa$) or salts thereof. Preferred examples of the anionic polymer are (1) carboxy-modified polyvinyl alcohol, (2) cellulose ethers such as carboxymethylcellulose, carboxyethylcellulose, and sodium salts thereof and sulfoethylcellulose ether, (3) oxidized starch, (4) polymers of acrylic acid and methacrylic acid and sodium salts or copolymers thereof, (5) anionically modified polyacrylamide, and (6) water-soluble polyesters such as copolyesters having polyethylene glycol units as at least a part of the diol component and having one or more sodiosulfo groups bound to the aromatic nucleus (see, for example, Japanese Examined Patent Publication No. 47-40873).

The cationic polymer usable for the present invention may include water-soluble polymers having on the backbone, ends, or side chains thereof one or more primary, secondary, or tertiary groups or salts thereof or quaternary ammonium groups. Preferred examples of the water-soluble cationic polymer are (1) polyalkylene polyamines and their derivatives, such as polyethylene-imine, polyamide epichlorohydrin, polyamide-polyamine epichlorohydrin (PPE) (see, for example, U.S. Pat. No. 2,926,116), polyvinyl imidazoline, and polyvinyl imidazoline salts, (2) cationically modified polyacrylamide, (3) cyclic polymers of diallylammonium halides (see, for example, U.S. Pat. No. 3,288,770), (4) polyvinyl pyridine, (5) polymers of dialkylaminoethyl acrylate or methacrylate, (6) cationically modified urea-formaldehyde resin, and (7) cationically modified melamine-formaldehyde resin.

In the process according to the present invention, the aqueous anionic polymer solution is mixed with the aqueous cationic polymer solution to form a binder slurry containing solid aggregate particles. Such a binder slurry may advantageously be employed for the production of paper or non-woven fabric based on synthetic fibers.

The concentrations of the solutions and the stirring conditions upon mixing of the solutions may vary depending upon the nature of the anionic polymer and the cationic polymer to be employed. However, in general, if both the solutions each having a concentration of 0.1% to 5% by weight are slowly brought into contact, a stable binder slurry containing solid aggregate particles of a uniform particle size can be obtained. The solid aggregate particles may preferably have a positive $\zeta$-potential in a slurry of fiber or pulp after the binder slurry is added to the fiber or pulp slurry in order to make easy fixation of the aggregate particles to the fiber or pulp since the fiber or pulp usually has a negative $\zeta$-potential. Thus, it will be appreciated that the aggregate particles should preferably have a negative $\zeta$-potential if the fiber or pulp has a positive $\zeta$-potential, i.e., if the slurry is a slurry of polyamide fiber or animal fiber, such as wool or silk, having a low pH value or a slurry of asbestos fiber.

Further, if desirable to make easy fixation of the aggregate particles to the fiber or pulp, the pH of the fiber or pulp slurry may be controlled or an anionic or cationic thickner may be added to the fiber or pulp slurry.

Alternatively, the aqueous anionic polymer solution is mixed with the aqueous cationic polymer solution to form a binder liuquid. Such a binder liquid may advantageously be employed for the production of paper or non-woven fabric based on natural pulp.

In one feature of the present invention, the binder liquid preferably contains liquid aggregate of the anionic polymer and the cationic polymer. In another feature of the present invention, the binder liquid preferably contains no liquid aggregate and has a pH value of not higher than 7. Using these liquids, the polymers can be deposited onto the fiber or pulp almost completely without employing a fixing agent. These preferred liquids can be obtained by controlling conditions such as the concentrations and temperatures of the polymer solutions and the stirring conditions upon mixing of the solutions, which conditions may vary depending upon the nature of the polymers. For example, where a 1% aqueous solution of a sodium carboxylate-modified polyvinyl alcohol ("Gosenal T-330", manufactured by Japan Synthetic Chemicals Corp.; polymerization degree, 1800; molar fraction of sodium carboxylate, not more than 2%) is employed as the aqueous anionic polymer solution, a 15% aqueous solution of PPE ("Polyfix 105", manufactured by Showa High Polymer Co. Ltd.) is employed as the aqueous cationic polymer solution, and both solutions are mixed at a temperature of 15° C. while being stirred, the preferred amount of PPE being 0.01 to 0.1 l per l of the modified polyvinyl alcohol solution.

Preferably, the binder liquid has a pH value of not more than 7. Since the fiber or pulp usually has a negative $\zeta$-potential, the polymers can easily be fixed onto the fiber or pulp if the cationic polymer exists in an excessive amount. Also, in this case, it will be appreciated that the binder liquid should preferably have a pH value of not less than 7 in the case where the fiber or pulp has a positive $\zeta$-potential.

As the fiber or pulp, there may be employed wood fibers such as groundwood pulp, kraft pulp, semi-chemical pulp, sulfite pulp, and soda pulp, vegetable fibers such as cotton, Manila hemp, jute, paper mulberry, mitsumata, and gampi, synthetic fibers or synthetic pulps of polyester, polyacrylonitrile, polyolefins, polyvinyl chloride, polyamides and polyvinyl alcohol, regenerated cellulose fibers such as viscose rayon and acetate fiber, inorganic fibers such as glass fiber, asbestos fiber and ceramic fiber, and mixtures of two or more thereof.

The slurry of fiber or pulp having the binder slurry or liquid mixed therewith is converted into paper or non-woven fabric by a conventional wet papermaking technique and the paper or non-woven fabric is then dried in a usual manner. The paper or non-woven fabric thus obtained generally has a fairly high strength and water resistance. However, it is preferable, in order to improve the strength, water resistance, and thermal resistance of the resultant paper or non-woven fabric, to subject the anionic polymer to an insolubilizing treatment or cross-linking treatment. For such treatment, known reactions concerning cellulose, polyvinyl alcohol, starch, acrylic or methacrylic acid polymers, polyesters, and the like can be utilized. For example, cellulose may be converted into an acetal or subjected to cyanoethylation or may be cross-linked by means of dimethylolethylene urea, dimethylol urea, or epichlorohydrin. Polyvinyl alcohol may be converted into an acetal or formal or may be subjected to esterification, etherification, or cross-linking by an aldehyde, an N-methylol compound, a dicarboxylic acid, a dicarboxylic acid chloride, a bis-halogen compound, a bis-epoxide, a bis-aziridine, epichlorohydrin, ethylene glycol diglycidyl ether, or the like. Acrylic or methacrylic acid polymers may be cross-linked by an oxide of a divalent or polyvalent metal or an organic acid salt or by a diamine, diol, or bis-epoxide.

The insolubilizing treatment or cross-linking treatment may be carried out at a separate stage with respect to the paper or non-woven fabric obtained by a wet papermaking technique. Alternatively, a cationic polymer being reactive to the anionic polymer may be employed as the cationic polymer to be mixed with the anionic polymer to also act as an insolubilizing agent or cross-linking agent. As such a cationic polymer, there may preferably be employed a cationic polymer having on at least a part of the ends or side chains thereof onne or more reactive groups such as epoxy, N-methylol, or isocyanate. Typical examples of the polymer may include cationically modified urea-formaldehyde resin, PPE, and polyamide-polyamine-polyester-polyether epichlorohydrin. The cationic polymers may be appropriately selected depending upon the reacivity thereof regarding the employed anionic polymer. However, the combination of an anionic polymer selected from the hereinbefore-mentioned carboxy-modified polyvinyl alcohol and water-soluble polyester and a cationic polymer selected from the hereinbefore-mentioned cationically modified melamine-formaldehyde resin and PPE is particularly preferred as being able to produce paper or non-woven fabric having an excellent strength, water resistance, and hot-water resistance.

In Japanese Unexamined Patent Publication No. 55-62298, there is described the production of paper or non-woven fabric having an excellent hot-water resistance by using of polyvinyl alcohol and polyamide-1-halogen-2,3-epoxy resin. However, this reference does not describe any liquid containing carboxy-modified polyvinyl alcohol and polyamide-1-halogen-2,3-epoxy resin or the incorporation of such a liquid into a fiber or pulp slurry.

Further, a melamine-acidified colloidal solution may be added to the fiber or pulp slurry or to the binder slurry or liquid for insolubilizing or cross-linking of the anionic polymer. The melamine-acidified colloidal solution may be fixed onto the fiber or pulp or onto the anionic polymer to cross-link and insolubilize the anionic polymer.

According to the process of the present invention, there can stably be obtained paper or non-woven fabric excellent in strength, water resistance, and thermal resistance by a simple operation, and, thus, the present invention may broadly be applied to the production of paper or non-woven fabric using wood fibers, vegetable fibers, animal fibers, semi-synthetic fibers, synthetic fibers, and inorganic fibers.

The present invention will further be illustrated by way of the following non-limitative examples. In the examples, the strength and freeness of the paper or non-woven fabric were measured as follows.

Freeness Number (cc)

This was measured according to JIS (Japanese Industrial Standard) P-8121 using a canadian standard freeness tester (manufactured by Kumagai Machinery Co. Ltd.).

Standard Strength (kg/15 mm)

This was measured according to JIS P-8113 at 20° C. and 65% RH, using a constant extension-rate type of tensile strength tester having a width of 15 mm, a distance between the clamps of 50 mm, and an extension rate of 50 mm/min.

Wet Strength (kg/15 mm)

A sample was immersed for 30 minutes in water having a temperature of 20° C. and thereafter the above-mentioned measurement for standard strength was carried out.

EXAMPLE 1

200 cc of a 0.6% by weight aqueous solution of polyvinyl imidazoline was gradually added, while being stirred, at about 17° C. to 200 cc of a 2% by weight aqueous solution of 5-sodiosulfonyl isophthalate copolyester ("Eastman WD Size, manufactured by Eastman Kodak Co.) to form, a binder slurry of white solid precipitates. The solid aggregate particles of the slurry had a size of about 70 to 150 μm.

2 g of polyester fibers ("TM04", manufactured by Teijin Ltd.; fineness, 1.5 deniers; length, 5 mm) was dispersed in 2 l of water to form a fiber slurry. A total of 40 cc of the above-mentioned binder slurry was added to the fiber slurry, and then 200 cc of a 0.01% aqueous solution of an anionic polyacrylamide ("Meipam", manufactured by Meisei Chemical Works Co. Ltd.) was added as a thickner. The slurry was then formed into a wet sheet on a laboratory papermaking machine, and the sheet was dried on a drum dryer at 120° C. to form a paper of 25 cm×25 cm. The paper was immersed in a 1% to 4% aqueous solution of trimethylolmelamine ("Sumitex Resin M-3", manufactured by Sumitomo Chemical Co. Ltd.) containing "Sumitex Accelerator AC" (manufactured by Sumitomo Chemical Co. Ltd.) as a catalyst in an amount equal to 1/10 of the amount of the trimethylolmelamine. Then the paper was dried and cured.

The physical properties of the obtained paper are shown in Table 1 below. The paper had a strength sufficient to form a paper layer after sheet formation and drying but the strength was not sufficient enough for the paper to be practically used. The paper had a high standard strength and a high wet strength.

TABLE 1

| | Concentration of Methylol-melamine (%) | Standard Strength (kg/15 mm) | Wet Strength (kg/15 mm) |
|---|---|---|---|
| After Sheet Formation and Drying | — | 0.8 | 0.4 |
| After Methylol-melamine treatment | 1 | 1.4 | 0.9 |
| | 2 | 1.9 | 1.7 |
| | 4 | 2.7 | 2.6 |

EXAMPLE 2

150 cc of an aqueous solution (having the concentration shown in Table 2) of PPE ("Polyfix 105", manufactured by Showa High Polymer Co. Ltd.) was gradually added to 150 cc of a 0.267% aqueous solution of a copolyester (having the composition shown in Table 2) while being stirred. The mixture was stirred for 10 minutes more to prepare a binder liquid or slurry. Where the concentration of PPE was low, a white turbid liquid was formed. Where the concentration of PPE was high, solid particles started to form. The higher the concentration of PPE was, the larger the particle size was, so that particles of a size of 50 to 100 μm were formed at an appropriate concentration. Where the concentration of PPE was too high, solid particles of too large a size formed, and where the concentration was further increased, solid particles were not formed.

300 cc of the thus obtained liquid or slurry was added to 2 l of a slurry of polyester fibers (polyethylene terephthalate staple fibers having a fineness of 0.5 deniers and a length of 5 mm) having a concentration of 1 g/l and then 200 cc of a 0.01% aqueous solution of an anionic polyacrylamide ("Meipam", manufactured by Meisei Chemical Works Co. Ltd.) was added as a thickner. The fiber slurry was then formed into a wet sheet on a laboratory papermaking machine, and the sheet was dried at 120° C. and heat treated at 160° C. for 5 minutes to obtain a paper having a weight of 40 g/m$^2$.

When the fiber slurry having the binder slurry added was observed with a microscope, it was proved that the binder particles having an appropriate size were fixed onto the fibers almost completely and networks of the fibers were formed while allowing the binder particles to be fixed at the intersecting points of the fiber. In this case, dispersion of the fibers was very good and the slurry was converted into a paper having an excellent surface texture and a high strength. Where the concentration of PPE was low, fixation of the binder particles to the fibers was poor and the obtained paper had a good surface texture but not so high a strength. Where the concentration of PPE was too high so that binder particles of too large a size were formed, fixation of the binder particles to the fibers was excellent; but the fibers aggregated when the thickner was added, and the resultant paper had a bad surface texture and a low strength.

The obtained results are shown in Table 2 below.

TABLE 2

| Run No. | Composition of Copolyester (weight ratio) Acid Component | Diol Component | Concentration of PPE (solid %) | Condition of Binder | Surface Texture of Paper | Strength of Paper (kg/15 mm) Standard | Wet |
|---|---|---|---|---|---|---|---|
| 1 | DMT/SSI (90/10) | EG/DEG (85/15) | 0.04 | White turbid | Good | 1.0 | 0.5 |
| 2 | | | 0.05 | Moderate size particles | Good | 1.5 | 0.9 |
| 3 | | | 0.06 | Moderate size particles | Good | 2.1 | 1.3 |
| 4 | | | 0.07 | Moderate size particles | Good | 1.8 | 1.0 |
| 5 | | | 0.08 | Too large-size particles | Bad | 1.6 | 1.0 |
| 6 | DMT/SSI/Trimellitic | EG/DEG (85/15) | 0.03 | White turbid | Good | 1.6 | 1.0 |
| 7 | Acid (90/10/0.8) | | 0.04 | Moderate-size particles | Good | 2.4 | 1.7 |
| 8 | | | 0.05 | Moderate-size particles | Good | 3.5 | 2.9 |
| 9 | | | 0.06 | Moderate-size particles | Good | 3.0 | 1.8 |

TABLE 2-continued

| Run No. | Composition of Copolyester (weight ratio) Acid Component | Diol Component | Concentration of PPE (solid %) | Condition of Binder | Surface Texture of Paper | Strength of Paper (kg/15 mm) Standard | Wet |
|---|---|---|---|---|---|---|---|
| 10 | | | 0.07 | Too large-size particles | Bad | 2.8 | 1.4 |
| 11 | DMT/SSI (95/5) | ED/DEG (70/30) | 0.04 | White turbid | Good | 1.3 | 1.0 |
| 12 | | | 0.05 | Moderate-size particles | Good | 1.8 | 1.3 |
| 13 | | | 0.06 | Moderate-size particles | Good | 2.7 | 2.4 |
| 14 | | | 0.07 | Moderate-size particles | Good | 1.9 | 1.3 |
| 15 | | | 0.08 | Too large-size particles | Bad | 1.5 | 0.9 |
| 16 | DMT/DMI/SSI | EG/DEG (70/30) | 0.05 | White turbid | Good | 2.3 | 1.3 |
| 17 | (52/43/5) | | 0.06 | Moderate-size particles | Good | 3.8 | 1.6 |
| 18 | | | 0.07 | Moderate-size particles | Good | 4.4 | 3.0 |
| 19 | | | 0.08 | Moderate-size particles | Good | 3.9 | 2.5 |
| 20 | | | 0.09 | Too large-size particles | Bad | 2.5 | 1.6 |

DMT dimethyl terephthalate.
SSI sodiosulfo isophthalate.
DMI dimethyl isophthalate.
EG ethylene glycol.
DEG diethylene glycol.
PPE polyamide-polyamine epichlorohydrin.

EXAMPLE 3

100 cc of a 0.9% by weight aqueous solution of PPE ("Polyfix 105", manufacture by Showa High Polymer Co. Ltd.) was gradually added to 200 cc of a 2% by weight aqueous solution of 5-sodiosulfonyl isophthalate copolyester ("Eastman WD Size", manufactured by Eastman Kodak Co.) while being stirred to form a binder slurry of white solid precipitates. The slurry was then diluted with water to a volume of 2 liters. The diluted slurry contained solid aggregate particles of a size of 50 to 100 $\mu$m and had a $\zeta$-potential of +21 mV at a pH of 8.1. The slurry was stable for more than 5 hours while being continuously stirred.

Polyester fibers as used in Example 1 or polyvinyl alcohol fibers ("UPB 103", manufactured by Kuraray Co.; fineness, 1 denier; length, 5 mm) were slurried as described in Example 1, and to 2 l of the fiber slurry 200 cc of the above-mentioned binder slurry was added. Next, the mixed slurry was slowly stirred for about 10 minutes and then 200 cc of an aqueous solution of an anionic polyacrylamide ("Meipam", manufactured by Meisei Chemical Works Co. Ltd.) having a concentration of 2 g/l was added as a thickner. Immediately thereafter, the slurry was formed into a wet sheet and dried as described in Example 1. The resultant fabric had a weight of 40 g/m$^2$. The slurry had a pH value of 8.1 before papermaking was carried out.

No retention of the aggregate particles or stopage of the forming wire was observed at all after the wet sheet was removed from the forming wire, and, in addition, the non-woven fabric was very smoothly separated from the drum surface of the drum dryer after drying.

The resultant non-woven fabric was then heat treated at 180° C. for 5 minutes.

The strength of the fabric is shown in Table 3 below.

TABLE 3

| Starting Fibers | Strength of Paper (kg/15 mm) After Drying Standard | Wet | After Heat Treatment Standard | Wet |
|---|---|---|---|---|
| Polyvinyl Alcohol Fibers | 3.62 | 1.96 | 4.73 | 3.92 |
| Polyester Fibers | 4.15 | 2.03 | 5.31 | 4.75 |

EXAMPLE 4

To 20 cc of a 1% aqueous solution of a sodium carboxylate-modified polyvinyl alcohol ("Gosenal T-330", manufactured by Japan Synthetic Chemicals Corp.; polymerization degree, 1800; molar fraction of sodium carboxylate, not more than 2%), a 15% aqueous solution of PPE ("Polyfix 105", manufactured by Showa High Polymer Co. Ltd.) was added in an amount of 0.05 cc (0.0075 g of solid), 0.10 cc (0.015 g of solid), 0.25 cc (0.0375 g of solid), 0.40 cc (0.06 g of solid), 0.50 cc (0.075 g of solid), or 0.90 cc (0.135 g of solid) while being stirred to form a binder liquid. Where the amount of the PPE solution was 0.05 cc, 0.50 cc, and 0.90 cc, clear liquids were obtained while where the amount was 0.10 cc, 0.05 cc, and 0.40 cc, white turbid liquids were obtained. The pH values of the respective binder liquids are shown in Table 4.

Unbleached kraft pulp having a concentration of 2% was beaten on a disc refiner (manufactured by Kumagai Machinery Co.) to obtain a pulp of 0.15% having a freeness number of 400 cc. To 2 l of the pulp (solid pulp content, 3 g), the above-mentioned binder liquid was added. The stock was then formed into a wet sheet on a laboratory papermaking machine, and the sheet was dried on a cylinder dryer at 120° C. to obtain a paper having a weight of 50 g/m$^2$.

The properties of the resultant paper are shown in Table 4 below.

Further, the relationship between the pH of the binder liquid and the added amount of PPE solution and the condition of the binder liquid are shown in the accompanying drawing (FIG. 1).

TABLE 4

| Run No. | Amount of Modified Polyvinyl Alcohol (solid %)* | Amount of PPE (solid %)* | Binder Liquid pH | Binder Liquid Condition | Strength of Paper (kg/15 mm) Standard | Strength of Paper (kg/15 mm) Wet | Remarks |
|---|---|---|---|---|---|---|---|
| 1. | 0 | 0 | — | — | 2.1 | Not measurable | Comparison |
| 2. | 6.7 | 0 | 8.16 | Clear | 4.2 | " | " |
| 3. | 6.7 | 0.25 | 7.77 | " | 4.8 | 0.7 | Invention |
| 4. | 6.7 | 0.50 | 7.32 | White turbid | 6.1 | 1.5 | " |
| 5. | 6.7 | 1.25 | 6.35 | " | 6.8 | 2.3 | " |
| 6. | 6.7 | 2.00 | 6.07 | " | 6.5 | 2.8 | " |
| 7. | 6.7 | 2.50 | 6.04 | Clear | 5.9 | 2.5 | " |
| 8. | 6.7 | 4.50 | 5.91 | " | 5.6 | 2.3 | " |

*Based on the weight of the solid pulp and fiber.

As can be seen from the table, the wet strength of the paper increased as the amount of PPE was increased and, in particular, the paper sheets of Run Nos. 4, 5, and 6 where the binder liquid was white turbid were excellent in both standard strength and wet strength.

EXAMPLE 5

150 cc of a 2% (solid) aqueous solution of PPE ("Polyfix 105", manufactured by Showa High Polymer Co. Ltd.) was gradually added to 150 cc of a 2% aqueous solution of carboxymethylcellulose ("Cellogen WS-C", manufactured by Daiichi Kogyo Seiyaku Co. Ltd.) while being stirred. The obtained liquid was cloudy and contained liquid aggregate.

30 cc of the liquid was added to 2 l of a polyester fiber slurry (2 g/2 l) as used in Example 1. The slurry was then formed into a wet sheet on a laboratory hand papermaking device and the sheet was dried. The weight of the obtained paper was 40 g/m$^2$, and the standard strength and wet strength were 2.5 kg/15 mm and 1.5 kg/15 mm, respectively.

We claim:

1. A process for producing paper or wet non-woven fabric comprising mixing an aqueous anionic polymer solution with an aqueous cationic polymer solution to form a mixture containing solid aggregate of the two polymers, and wherein the anionic polymer is a copolyester containing polyethylene glycol as the diol component and isosphthalic acid and an aromatic dicarboxylic acid having a sodiosulfo group bound to the aromatic nucleus as the dicarboxylic acid component, adding the mixture to a slurry of fiber or pulp, converting the slurry into paper or non-woven fabric by a wet papermaking technique, and drying the paper or non-woven fabric.

2. A process as claimed in claim 1, wherein the cationic polymer is a polymer having at least one reactive group selected from the group consisting of epoxy, N-methylol, and isocyanate groups on at least a part of the ends and side chains thereof.

3. A process as claimed in claim 2, wherein the cationic polymer is polyamide-polyamine epichlorohydrin.

4. The product produced by the process of claim 1.

* * * * *